US005754733A

United States Patent [19]

Gardner et al.

[11] Patent Number: 5,754,733

[45] Date of Patent: May 19, 1998

[54] METHOD AND APPARATUS FOR GENERATING AND ENCODING LINE SPECTRAL SQUARE ROOTS

[75] Inventors: William R. Gardner; Sharath Manjunath; Peter A. Monta, all of San Diego, Calif.

[73] Assignee: Qualcomm Incorporated, San Diego, Calif.

[21] Appl. No.: 509,848

[22] Filed: Aug. 1, 1995

[51] Int. Cl.[6] ..... G10L 3/02

[52] U.S. Cl. ..... 395/2.28; 395/2.2; 395/2.25; 395/2.26; 395/2.27

[58] Field of Search ..... 395/2.2, 2.25, 395/2.26, 2.27, 2.28

[56] References Cited

U.S. PATENT DOCUMENTS

| | | | |
|---|---|---|---|
| 4,975,956 | 12/1990 | Liu et al. | 395/2.28 |
| 5,012,518 | 4/1991 | Liu et al. | 395/2.28 |
| 5,414,796 | 5/1995 | Jacobs et al. | 395/2.3 |

OTHER PUBLICATIONS

Huang Zailu, "An 800 bit/s LSP Vocoder–With ANN Vector Quantizer", *Electro International Conference Record*, vol. 18, Jan. 1993, pp. 41–44.

Frank K. Soong et al., "Line Spectrum Pair (LSP) and Speech Data Compression", *International Conference on Acoustics, Speech and Signal Processing 84*, vol. 1, Mar. 19, 1984, pp. 1.10.1–1–10.4.

Philippe Delsarte et al., "Split Levinson Algorithm", *IEEE Transactions on Acoustic, Speech and Signal Processing*, vol .ASSP–34, No. 3, Jun. 1986, pp. 470–478.

"Optimal Quantization of LSP Parameters", Soong et al, ICASSP 1988.

"Line Spectrum Pairs—a review", Smith et al, COMSIG 1988, South African Conference on communications and Signal Processing.

"A Two–Level Method Using a Decimation–In–Degree Algorigthm for the Computation of the LSP Frequencies", Chen et al, 0–7803–2440–4, 1994.

"Computation of LSP Parameters from reflection coefficients", chan et al, Electronic Letters, vol. 27, Issue 19, Sep. 12,1991.

"An initrinsically reliable and fast algorithm to compute th LSP in low bit rate CELP coding", Goalic et al, ICASSP 1995, vol. 1.

"Enhanced Distance Measure for LSP–Based Speech Recognition", Kim et al, Electronic Letters, vol. 29, Issue 16, Aug. 5, 1993.

"Quantizer design in LSP speech analysis and synthesis", Sugamura et al, ICASSP '88, 1988.

"Efficient Encoding of Speech LSP Parameters using the Discrete Cosine Transformation", ICASSP, 1989.

"Comprehensice improvement in low bit rate speech coding", GLOBECOM 1989: IEEE Global Telecom Conference, 1989.

"A study of line spectrum pair frequencies fpr speech recognition", ICASSP, 1988.

*Primary Examiner*—Allen R. MacDonald
*Assistant Examiner*—Michael N. Opsasnick
*Attorney, Agent, or Firm*—Russell B. Miller; Sean English; Linli L. Golden

[57] ABSTRACT

A novel and improved method and apparatus for encoding line predictive coding (LPC) data in a speech compression system using line spectral square root values is disclosed. A novel and computationally efficient procedure for determining the set of quantization sensitivities for the line spectral square root values is disclosed, which results in a computationally efficient error measure for use in vector quantization of the line spectral square root values. A novel method of weighting the quantization error is disclosed, which accumulates the quantization error in each line spectral square root value and weights that error by the sensitivity of that line spectral square root value.

20 Claims, 4 Drawing Sheets

METHOD AND APPARATUS FOR GENERATING AND ENCODING LINE SPECTRAL SQUARE ROOTS

BACKGROUND OF THE INVENTION

I. Field of the Invention

The present invention relates to speech processing. More specifically, the present invention is a novel and improved method and apparatus for encoding LPC coefficients in a linear prediction based speech coding system.

II. Description of the Related Art

Transmission of voice by digital techniques has become widespread, particularly in long distance and digital radio telephone applications. This has created interest in methods which minimize the amount of information transmitted over a channel while maintaining the quality of the speech reconstructed from that information. If speech is transmitted by simply sampling the continuous speech signal and quantizing each sample independently, a data rate around 64 kilobits per second (kbps) is required to achieve a reconstructed speech quality similar to that of a conventional analog telephone. However, through the use of speech analysis, followed by the appropriate coding, transmission, and resynthesis at the receiver, a significant reduction in the data rate can be achieved.

Devices which compress speech by extracting parameters of a model of human speech production are called vocoders. Such devices are composed of an encoder, which analyzes the incoming speech to extract the relevant parameters, and a decoder, which resynthesizes the speech using the parameters which it receives from the encoder over the transmission channel. To accurately represent the time varying speech signal, the model parameters are updated periodically. The speech is divided into blocks of time, or analysis frames, during which the parameters are calculated and quantized. These quantized parameters are then transmitted over a transmission channel, and the speech is reconstructed from these quantized parameters at the receiver.

The Code Excited Linear Predictive Coding (CELP) method is used in many speech compression algorithms. An example of a CELP coding algorithm is described in the paper "A 4.8 kbps Code Excited Linear Predictive Coder" by Thomas E. Tremain et al., *Proceedings of the Mobile Satellite Conference*, 1988. An example of a particularly efficient vocoder of this type is detailed in U.S. Pat. No. 5,414,796, entitled "Variable Rate Vocoder" and assigned to the assignee of the present invention and incorporated by reference herein.

Many speech compression algorithms use a filter to model the spectral magnitude of the speech signal. Because the coefficients of the filter are computed for each frame of speech using linear prediction techniques, the filter is referred to as the Linear Predictive Coding (LPC) filter. Once the filter coefficients have been determined, the filter coefficients must be quantized. Efficient methods for quantizing the LPC filter coefficients can be used to decrease the bit rate required to encode the speech signal.

One method for quantizing the coefficients of the LPC filter involves transforming the filter coefficients to Line Spectral Pair (LSP) parameters, and quantizing the LSP parameters. The quantized LSPs are then transformed back to LPC filter coefficients, which are used in the speech synthesis model at the decoder. Quantization is performed in the LSP domain because LSP parameters have better quantization properties than LPC parameters, and because the ordering property of the quantized LSP parameters guarantees that the resulting quantized LPC filter will be stable.

For a particular set of LSP parameters, quantization error in one parameter may result in a larger change in the LPC filter response, and thus a larger perceptual degradation, than the change produced by a similar amount of quantization error in another LSP parameter. The perceptual effect of quantization can be minimized by allowing more quantization error in LSP parameters which are less sensitive to quantization error. To determine the optimal distribution of quantization error, the individual sensitivity of each LSP parameter must be determined. A preferred method and apparatus for optimally encoding LSP parameters is described in detail in copending U.S. patent application, Ser. No. 08/286,150, filed Aug. 4, 1994, entitled "Sensitivity Weighted Vector Quantization of Line Spectral Pair Frequencies," which is assigned to the assignee of the present invention and incorporated by reference herein.

SUMMARY OF THE INVENTION

The present invention is a novel and improved method and apparatus for quantizing LPC parameters which uses line spectral square root (LSS) values. The present invention transforms the LPC filter coefficients into an alternative set of data which is more easily quantized than the LPC coefficients and which offers the reduced sensitivity to quantization errors that is a prime benefit of LSP frequency encoding. In addition, the transformations from LPC coefficients to LSS values and from LSS values to LPC coefficients are less computationally intensive than the corresponding transformations between LPC coefficients and LSP parameters.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
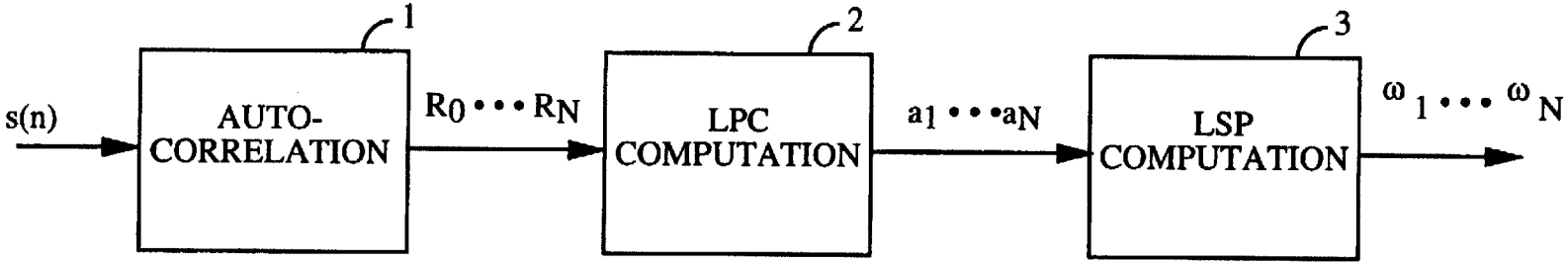
FIG. 1 is a block diagram illustrating the prior art apparatus for generating and encoding LPC coefficients.

FIG. 1 illustrates the traditional apparatus for generating and encoding LPC filter data by determining the LPC coefficients (a(1), a(2), . . . , a(N)) and from those LPC coefficients generating the LSP frequencies ($\omega(1), \omega(2), \ldots, \omega(N)$). N is the number of filter coefficients in the LPC filter. Speech autocorrelation element 1 computes a set of autocorrelation values, R(0) to R(N), from the frame of speech samples, s(n) in accordance with equation (1) below:

$$R(n) = \sum_{k=1}^{L+1-n} s(k) \cdot s(k+n), \quad (1)$$

where L is the number of speech samples in the frame over which the LPC coefficients are being calculated. In the exemplary embodiment, the number of samples in a frame is 160 (L=160), and the number of LPC filter coefficients is 10 (N=10).

Linear prediction coefficient (LPC) computation element 2 computes the LPC coefficients, a(1) to a(N), from the set of autocorrelation values, R(0) to R(N). The LPC coefficients may be obtained by the autocorrelation method using Durbin's recursion as discussed in *Digital Processing of Speech Signals* Rabiner & Schafer, Prentice-Hall, Inc., 1978. The algorithm is described in equations (2)–(7) below:

$$E^{(0)} = R(0),\ i = 1; \quad (2)$$

$$k_i = \left\{ R(i) - \sum_{j=1}^{i-1} \alpha_j^{(i-1)} R(i-j) \right\} / E^{(i-1)}; \quad (3)$$

$$\alpha_i^{(i)} = k_i; \quad (4)$$

$$\alpha_j^{(i)} = \alpha_j^{(i-1)} - k_i \alpha_{i-j}^{(i-1)} \text{ for } 1 <= j <= i-1; \quad (5)$$

$$E^{(i)} = (1 - k_i^2) E^{(i-1)}; \text{ and} \quad (6)$$

If $i < 10$ then goto equation (16) with $i = i + 1$. (7)

The N LPC coefficients are labeled $\alpha_j^{(10)}$, for $1 \leqq j \leqq N$. The operations of both element 1 and 2 are well known. In the exemplary embodiment, the formant filter is a tenth order filter, meaning that 11 autocorrelation values, R(0) to R(10), are computed by autocorrelation element 1, and 10 LPC coefficients, a(1) to a(10), are computed by LPC computation element 2.

LSP computation element 3 converts the set of LPC coefficients into a set of LSP frequencies of values $\omega_1$ to $\omega_N$. The operation of LSP computation element 3 is well known and is described in detail in the aforementioned U.S. Pat. No. 5,414,796. Motivation for the use of LSP frequencies is given in the article "Line Spectrum Pair (LSP) and Speech Data Compression", by Soong and Juang, *JCASSP* '84.

The computation of the LSP parameters is shown below in equations (8) and (9) along with Table I. The LSP frequencies are the N roots which exist between 0 and $\pi$ of the following equations:

$$p(\omega) = \frac{p_{N/2}}{2} + p_{N/2-1} \cos \omega + \ldots + p_1 \cos\left[\left(\frac{N}{2} - 1\right) \cdot \omega\right] + \cos \frac{N}{2} \omega \quad (8)$$

$$q(\omega) = \frac{q_{N/2}}{2} + q_{N/2-1} \cos \omega + \ldots + q_1 \cos\left[\left(\frac{N}{2} - 1\right) \cdot \omega\right] + \cos \frac{N}{2} \omega, \quad (9)$$

where the $p_n$ and $q_n$ values for n=1, 2, . . . N/2 are defined recursively in Table I.

TABLE I

| | |
|---|---|
| $p_1 = -(a(1) + a(N)) - 1$ | $q_1 = -(a(1) - a(N)) + 1$ |
| $p_2 = -(a(2) + a(N-1)) - p_1$ | $q_2 = -(a(2) - a(N-1)) + q_1$ |
| $p_3 = -(a(3) + a(N-2)) - p_2$ | $q_3 = -(a(3) - a(N-2)) + q_2$ |
| . | . |
| . | . |
| . | . |

In Table I, the a(1), . . . , a(N) values are the scaled coefficients resulting from the LPC analysis. A property of the LSP frequencies is that, if the LPC filter is stable, the roots of the two functions alternate; i.e. the lowest root, $\omega_1$, is the lowest root of $p(\omega)$, the next lowest root, $\omega_2$, is the lowest root of $q(\omega)$, and so on. Of the N frequencies, the odd frequencies are the roots of the $p(\omega)$, and the even frequencies are the roots of the $q(\omega)$.

Solving equations (8) and (9) to obtain the LSP frequencies is a computationally intensive operation. One of the primary source of computational loading in transforming the LPC coefficients to LSP frequencies and back from LSP frequencies to LPC coefficients results from the extensive use of the trigonometric functions.

One way to reduce the computational complexity is to make the substitution:

$$x = \cos\omega \quad (10)$$

Values of $\cos(n\omega)$ for n>1 can be expressed as combinations of powers of x, through recursive use of the following trigonometric identity:

$$\cos((n+1)\omega) = 2 \cdot \cos(\omega)\cos(n\omega) - \cos((n-1)\omega). \quad (11)$$

By extension of this identity, it can be shown that:

$$\cos(2\omega) = 2 \cdot \cos(\omega)\cos(\omega) - \cos(0) = 2x^2 - 1, \quad (12)$$

$$\cos(3\omega) = 2 \cdot \cos(\omega)\cos(2\omega) - \cos(\omega) = 2x(2x^2 - 1) - x = 4x^3 - 3x, \quad (13)$$

and so on.

By making these substitutions and grouping terms with common powers of x, equations (8) and (9) can be reduced to polynomials in x given by:

$$\tilde{p}(x) = \frac{\tilde{p}_{N/2}}{2} + \tilde{p}_{\frac{N}{2}-1} x + \tilde{p}_{\frac{N}{2}-2} x^2 + \ldots + \tilde{p}_1 x^{\frac{N}{2}-1} + x^{\frac{N}{2}} \quad (14)$$

$$\tilde{q}(x) = \frac{\tilde{q}_{N/2}}{2} + \tilde{q}_{\frac{N}{2}-1} x + \tilde{q}_{\frac{N}{2}-2} x^2 + \ldots + \tilde{q}_1 x^{\frac{N}{2}-1} + x^{\frac{N}{2}} \quad (15)$$

Thus, it is possible to provide the information provided by the LSP frequencies ($\omega_1 \ldots \omega_N$) by providing the values ($x_1 \ldots x_N$), which are referred to as the line spectral cosines ($x_1 \ldots x_N$). Determining the N line spectral cosine values involves finding the N roots of equations (14) and (15). This procedure requires no trigonometric evaluations, which greatly reduces the computational complexity. The problem with quantizing the line spectral cosine values, as opposed to the LSP frequencies, is that the line spectral cosine values with values near +1 and −1 are very sensitive to quantization noise.

Figure 2:
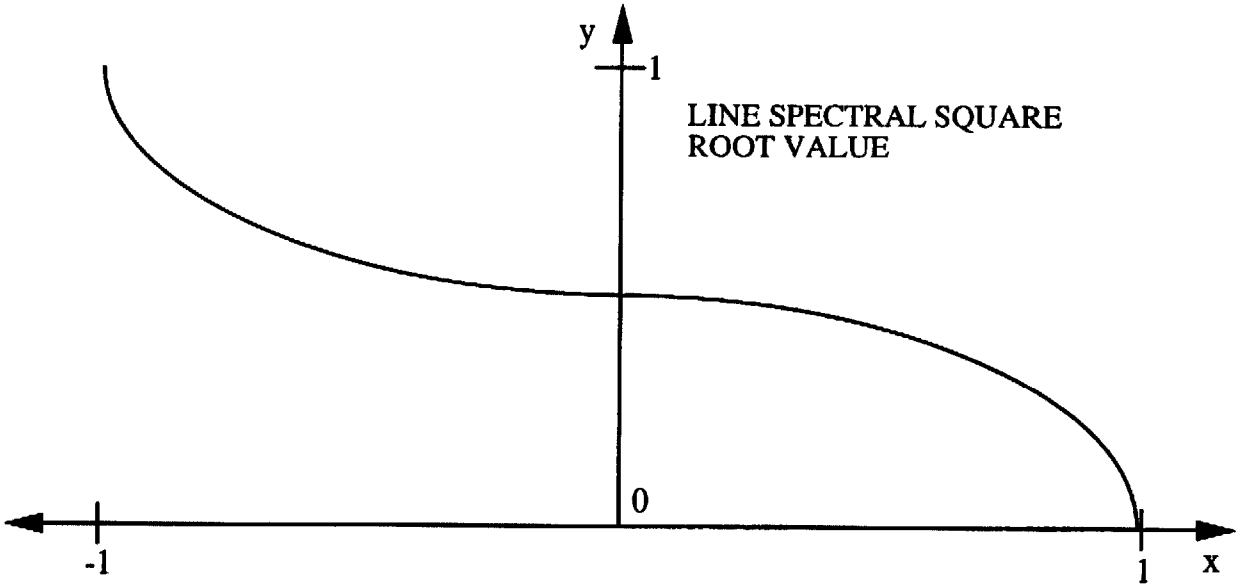
FIG. 2 illustrates the plot of the normalizing function used to redistribute the line spectral cosine values in the present invention.

In the present invention, the line spectral cosine values are made more robust to quantization noise by transforming them to a set of values referred herein as line spectral square root (LSS) values ($y_1 \ldots y_N$). The computation used to transform the line spectral cosine ($x_1 \ldots x_N$) values to line spectral square root ($y_1 \ldots y_N$) values is shown in equation (16) below:

$$y_i = \begin{cases} \frac{1}{2}\sqrt{1 - x_i}\ ; & 0 \leqq x_i < 1 \\ 1 - \frac{1}{2}\sqrt{1 + x_i}\ ; & -1 \leqq x_i < 0 \end{cases}, \quad (16)$$

where $x_i$ is the $i^{th}$ line spectral cosine value and $y_i$ is the corresponding $i^{th}$ line spectral square root value. The transformation from line spectral cosines to line spectral square-roots can be viewed as a scaled approximation to the transformation from line spectral cosines to LSPs, $\omega=\arccos(x)$. FIG. 2 illustrates a plot of the function of equation (16).

Because of this transformation, the line spectral square root values are more uniformly sensitive to quantization noise than are line spectral cosine values, and have properties similar to LSP frequencies. However, the transformations between LPC coefficients and LSS values require only product and square-root computations, which are much less computationally intensive than the trigonometric evaluations required by the transformations between LPC coefficients and LSP frequencies.

In an improved embodiment of the present invention, the line spectral square root values are encoded in accordance with computed sensitivity values and codebook selection method and apparatus described herein. The method and apparatus for encoding the line spectral square root values of the present invention maximize the perceptual quality of the encoded speech with a minimum number of bits.

Figure 3:
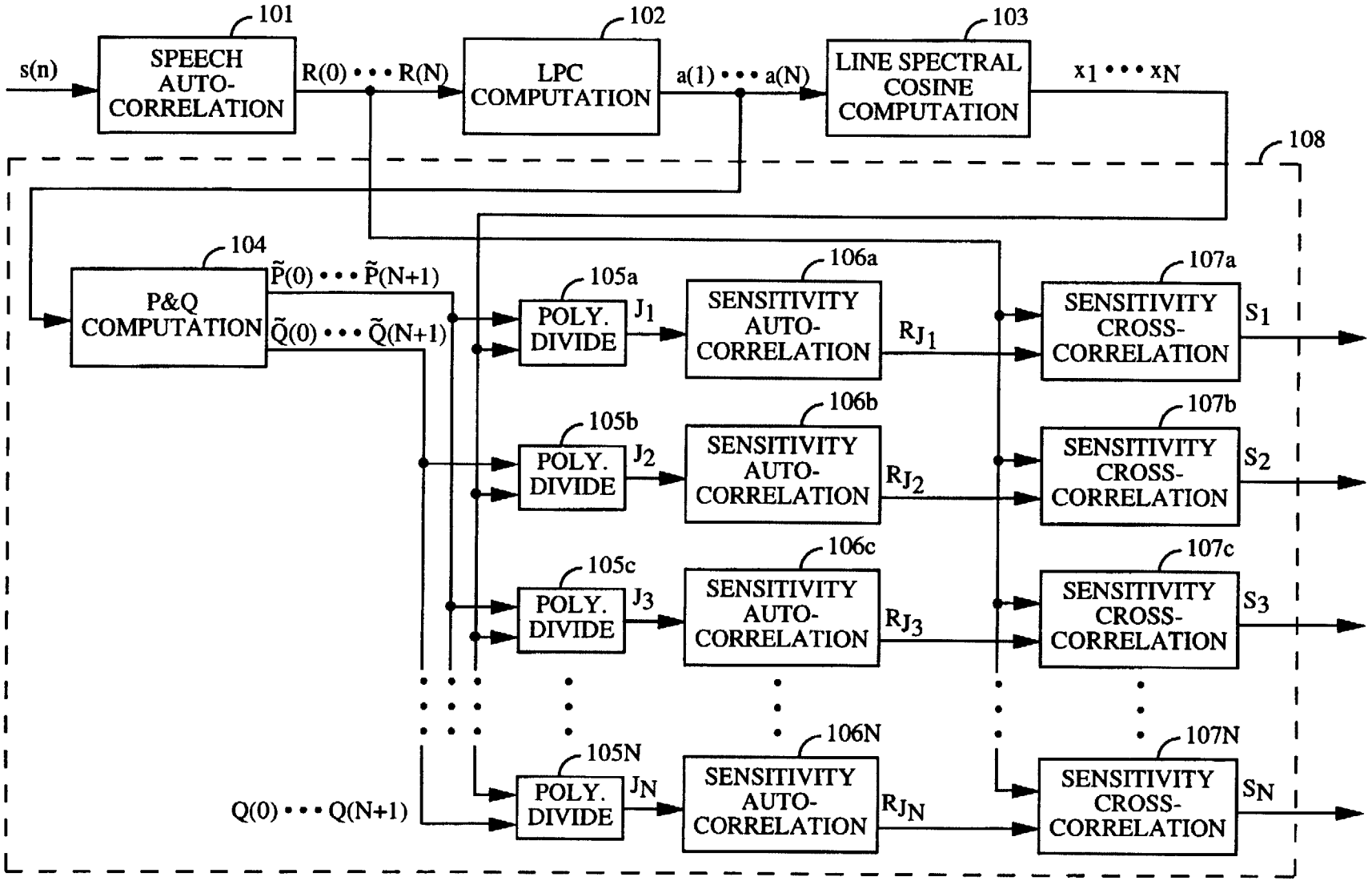
FIG. 3 illustrates the block diagram illustrating the apparatus for generating sensitivity values for encoding the line spectral square root values of the present invention.

FIG. 3 illustrates the apparatus of the present invention for generating the line spectral cosine values (x(1), x(2), . . . , x(N)) and the quantization sensitivities of the line spectral square root values ($S_1, S_2, \ldots, S_N$). As described earlier, N is the number of filter coefficients in the LPC filter. Speech autocorrelation element 101 computes a set of autocorrelation values, R(0) to R(N), from the frame of speech samples, s(n) in accordance with equation (1) above.

Linear prediction coefficient (LPC) computation element 102 computes the LPC coefficients, a(1) to a(N), from the set of autocorrelation values, R(0) to R(N), as described above in equations (2)–(7). Line spectral cosine computation element 103 converts the set of LPC coefficients into a set of line spectral cosine values, $x_1$ to $X_N$, as described above in equations (14)–(15). Sensitivity computation element 108 generates the sensitivity values ($S_1, \ldots, S_N$) as described below.

P & Q computation element 104 computes two new vectors of values, $\vec{P}$ and $\vec{Q}$, from the LPC coefficients, using the following equations (17)–(22):

$$P(0) = 1 \tag{17}$$
$$P(N+1) = 1 \tag{18}$$
$$P(i) = -a(i) - a(N+1-i)\ 0 < i < N+1 \tag{19}$$
$$Q(0) = 1 \tag{20}$$
$$Q(N+1) = -1 \tag{21}$$
$$Q(i) = -a(i) + a(N+1-i);\ 0 < i < N+1 \tag{22}$$

Polynomial division elements 105a–105N perform polynomial division to provide the sets of values $\vec{J}_i$, composed of $J_i(1)$ to $J_i(N)$, where i is the index of the line spectral cosine value for which the sensitivity value is being computed. For the line spectral cosine values with odd index ($x_1$, $x_3$, $x_5$ etc.), the long division is performed as follows:

$$z^2 - 2\cdot x_i\cdot z + 1\ \frac{J_i(N-1)z^{N-1} + J_i(N-2)z^{N-2} + \ldots + J_i(1)z + J_i(0)}{\sqrt{P(N+1)z^{N+1} + P(N)z^N + \ldots + P(1)z + P(0)}}, \tag{23}$$

and for the line spectral cosine values with even index ($x_2$, $x_4$, $x_6$, etc.), the long division is performed as follows:

$$z^2 - 2\cdot x_i\cdot z + 1\ \frac{J_i(N-1)z^{N-1} + J_i(N-2)z^{N-2} + \ldots + J_i(1)z + J_i(0)}{\sqrt{Q(N+1)z^{N+1} + Q(N)z^N + \ldots + Q(1)z + Q(0)}}. \tag{24}$$

If i is odd, $$J_i(k)=J_i(N+1-k). \tag{25}$$

Because of this symmetry only half of the division needs to be performed to determine the entire set of N $J_i$ values. Similarly, if i is even, $$J_i(k)=-J_i(N+1-k), \tag{26}$$

because of this anti-symmetry only half of the division needs to be performed.

Sensitivity autocorrelation elements 106a–106N compute the autocorrelations of the sets $\vec{J}_i$, using the following equation:

$$R_{Ji(n)} = \sum_{k=0}^{N-n-1} J_i(k)\cdot J_i(k+n). \tag{27}$$

Sensitivity cross-correlation elements 107a–107N compute the sensitivities for the line spectral square root values by cross correlating the $\vec{R}J_i$ sets of values with the autocorrelation values from the speech, $\vec{R}$, and weighting the results by $1-|x_i|$. This operation is performed in accordance with equation (28) below:

$$S_i = (1-|x_i|)\cdot\left[R(0)\cdot R_{Ji}(0) + 2\cdot\sum_{k=1}^{N} R(k)\cdot R_{Ji}(k)\right] \tag{28}$$

Figure 4:
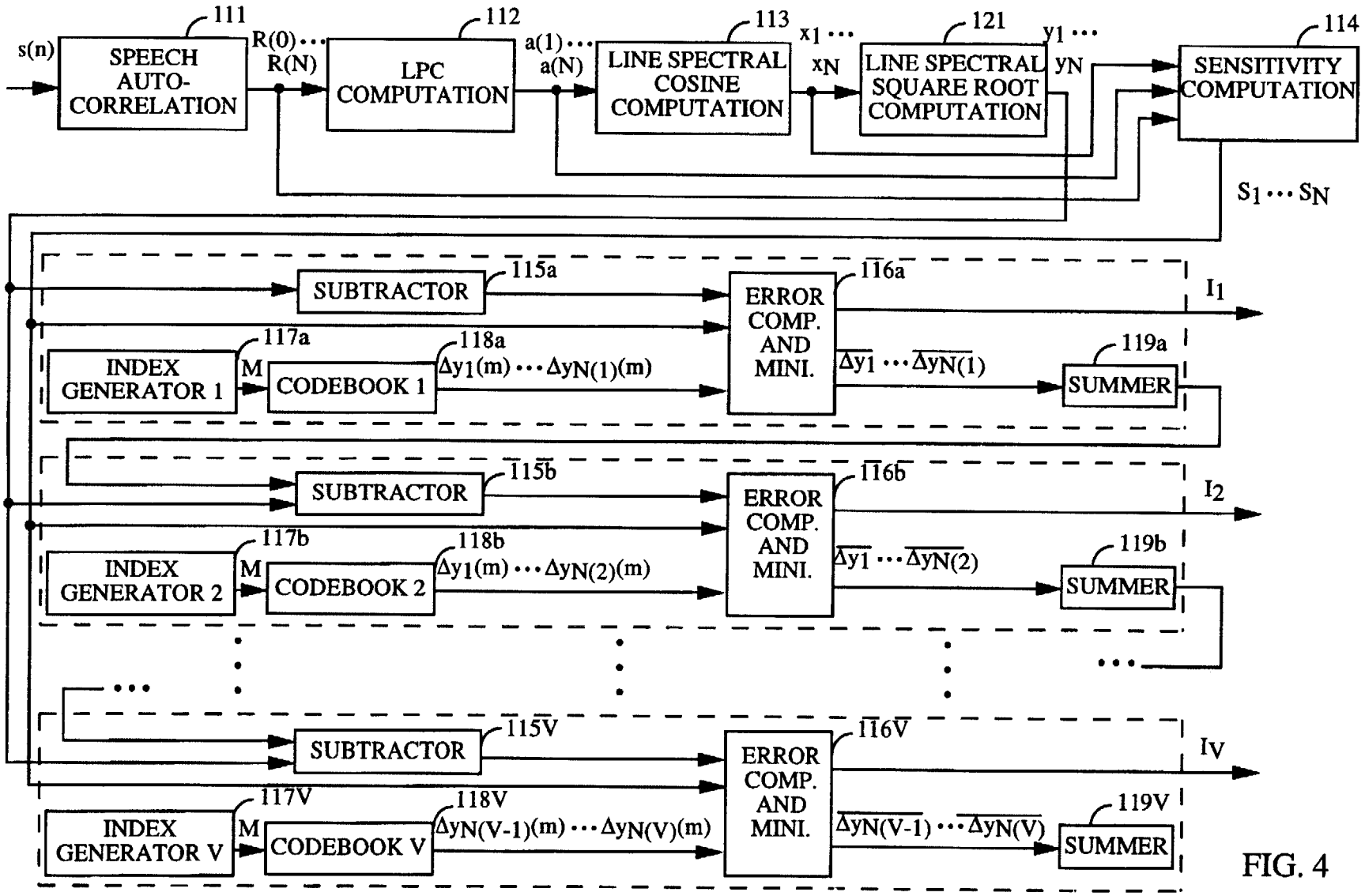
FIG. 4 is a block diagram illustrating the overall quantization mechanism for encoding the line spectral square root values.

FIG. 4 illustrates the apparatus of the present invention for generating and quantizing the set of line spectral square root values. The present invention can be implemented in a digital signal processor (DSP) or in an application specific integrated circuit (ASIC) programmed to perform the function as described herein. Elements 111, 112 and 113 operate as described above for blocks 101, 102 and 103 of FIG. 3. Line spectral cosine computation element 113 provides the line spectral cosine values ($x_1, \ldots, x_N$) to line spectral square root computation element 121, which computes the line spectral square root values, y(1) . . . y(N), in accordance with equation (16) above.

Sensitivity computation element 114 receives line spectral cosine values ($x_1, \ldots, X_N$) from line spectral cosine computation element 113, LPC values (a(1), . . . , a(N)) from LPC computation element 112 and autocorrelation values (R(0), . . . , R(N)) from speech autocorrelation element 111. Sensitivity computation element 114 generates the set of sensitivity values, $S_1, \ldots, S_N$, as described regarding sensitivity computation element 108 of FIG. 3.

Once the set of line spectral square root values, y(1) . . . y(N), and the set of sensitivities, $S_1, \ldots, S_N$, are computed, the quantization of the line spectral square root values begins. A first subvector of line spectral square root value differences, comprising $\Delta y_1, \Delta y_2, \ldots \Delta y_{N(1)}$, is computed by subtractor elements 115a as:

$$\Delta y_1 = y_1 \tag{29}$$
$$\Delta y_i = y_i - y_{i-1};\ 1 < i < N(1)+1 \tag{30}$$

The set of values N(1), N(2), etc. define the partitioning of the line spectral square root vector into subvectors. In the exemplary embodiment with N=10, the line spectral square root vector is partitioned into 5 subvectors of 2 elements each, such that N(1)=2, N(2)=4, N(3)=6, N(4)=8, and N(5)=10. V is defined as the number of subvectors. In the exemplary embodiment, V=5.

In alternate embodiments, the line spectral square root vector can be partitioned into different numbers of subvectors of differing dimension. For example, a partitioning into 3 subvectors with 3 elements in the first subvector, 3 elements in the second subvector, and 4 elements in the third subvector would result in N(1)=3, N(2)=6, and N(3)=10. In this alternative embodiment V=3.

After the first subvector of line spectral square root differences is computed in subtractor 115a, it is quantized by elements 116a, 117a, 118a, and 119a. Element 118a is a codebook of line spectral square root difference vectors. In the exemplary embodiment, there are 64 such vectors. The codebook of line spectral square root difference vectors can be determined using well known vector quantization training algorithms. Index generator 1, element 117a, provides a codebook index, m, to codebook element 118a. Codebook element 118a in response to index m provides the $m^{th}$ codevector, made up of elements $\Delta y_1(m), \ldots, \Delta y_{N(1)}(m)$.

Error computation and minimization element 116a computes the sensitivity weighted error, E(m), which represents the approximate spectral distortion which would be incurred by quantizing the original subvector of line spectral square root differences to this mth codevector of line spectral square root differences. In the exemplary embodiment, E(m) is computed as described by the following equations.

$$err = 0; \quad (31)$$
$$E(m) = 0; \quad (32)$$
$$\text{for } k = 1 \text{ to } N(1) \quad (33)$$
$$err = err + \Delta y_k - \Delta y_k(m) \quad (34)$$
$$E(m) = E(m) + S_k\, err^2 \quad (35)$$
$$\text{end loop} \quad (36)$$

E(m) is the sum of sensitivity weighted squared errors in the LSS values. The procedure for determining the sensitivity weighted error illustrated in equations (31)–(36) accumulates the quantization error in each line spectral square root value and weights that error by the sensitivity of the LSS value.

Once E(m) has been computed for all codevectors in the codebook, error computation and minimization (ERROR COMP. AND MINI.) element 116a selects the index m, which minimizes E(m). This value of m is the selected index to codebook 1, and is referred to as $I_1$. The quantized values of $\Delta y_1, \ldots, \Delta y_{N(1)}$ are denoted by $\overline{\Delta y_1} \ldots \overline{\Delta y_{N(1)}}$, and are set equal to $\Delta y_1(I_1), \ldots, \Delta y_{N(1)}(I_1)$.

In summer element 119a, the quantized line spectral square root values in the first subvector are computed as:

$$\overline{y_i} = \sum_{k=1}^{i} \overline{\Delta y_i}. \quad (37)$$

The quantized line spectral square root value $\overline{y_{N(1)}}$ computed in block 119a, and the $y_i$ for i from N(1)+1 to N(2) are used to compute the second subvector of line spectral square root differences, comprising $\Delta y_{N(1)+1}, \Delta y_{N(1)+2}, \ldots \Delta y_{N(2)}$ as follows:

$$\Delta y_i = y_{N(1)+1} - \overline{y_{N(1)}} \quad (38)$$
$$\Delta y_i = y_i - y_{i-1};\ N(1) < i < N(2) + 1 \quad (39)$$

The operation for selecting the second index value $I_2$ is performed in the same way as described above for selecting $I_1$.

The remaining subvectors are quantized sequentially in a similar manner. The operation for all of the subvectors is essentially the same and for instance the last subvector, the $V^{th}$ subvector, is quantized after all of the subvectors from 1 to V−1 have been quantized. The $V^{th}$ subvector of line spectral square root differences is computed by an element 115V as $$\Delta y_{N(V-1)+1} = y_{N(V-1)+1} - \overline{y_{N(V-1)}} \quad (40)$$

-continued $$\Delta y_i = \Delta y_i - \Delta y_{i-1};\ N(V-1) < i < N(V) + 1 \quad (41)$$

The $V^{th}$ subvector is quantized by finding the codevector in the $V^{th}$ codebook which minimizes E(m), which is computed by the following loop:

$$err = 0; \quad (42)$$
$$E(m) = 0; \quad (43)$$
$$\text{for } k = N(V-1) + 1 \text{ to } N(V) \quad (44)$$
$$err = err + \Delta y_k - \Delta y_k(m) \quad (45)$$
$$E(m) = E(m) + S_k\, err^2 \quad (46)$$
$$\text{end loop} \quad (47)$$

Once the best codevector for the $V^{th}$ subvector is determined, the quantized line spectral square root differences and the quantized line spectral square root values for that subvector are computed as described above. This procedure is repeated sequentially until all of the subvectors are quantized.

In FIG. 3 and FIG. 4, the blocks may be implemented as structural blocks to perform the designated functions or the blocks may represent functions performed in programming of a digital signal processor (DSP) or an application specific integrated circuit ASIC. The description of the functionality of the present invention would enable one of ordinary skill to implement the present invention in a DSP or an ASIC without undue experimentation.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. In a linear predictive coder, a subsystem for generating and encoding linear prediction coding (LPC) coefficients, comprising:

LPC generator means for receiving digitized speech samples and generating a set of LPC coefficients for said digitized speech samples in accordance with a linear prediction coding format;

line spectral cosine generator means for receiving said set of LPC coefficients and generating a set of line spectral cosine values in accordance with a line spectral cosine transform format; and line spectral square root means for receiving said set of line spectral cosine values and for generating a set of line spectral square root values in accordance with a square root transformation format.

2. The apparatus of claim 1 wherein said square root transformation format is:

$$y_i = \begin{cases} \frac{1}{2}\sqrt{1-x_i}\ ; & 0 \leq x_i < 1 \\ 1 - \frac{1}{2}\sqrt{1+x_i}\ ; & -1 \leq x_i < 0 \end{cases},$$

where $x_i$ is the ith line spectral cosine value and $y_i$ is the corresponding ith line spectral square root value.

3. The apparatus of claim 1 further comprising:

polynomial division means for receiving said set of line spectral cosine values and a set of linear prediction coding (LPC) coefficients and for generating a set of quotient coefficients in accordance with a predetermined polynomial division format; and sensitivity cross correlation means for receiving said set of quotient coefficients, said set of line spectral cosine values, and a set of speech auto correlation coefficients and for computing a set of line spectral square root sensitivity coefficients in accordance with a weighted cross-correlation computation format.

4. The apparatus of claim 3 further comprising a sensitivity autocorrelation means disposed between said polynomial division means and said sensitivity cross correlation means for receiving said set of quotient coefficients and generating a set of sensitivity autocorrelation values for said set of quotient coefficients in accordance with a predetermined autocorrelation computation format.

5. The apparatus of claim 3 further comprising a vector computation means disposed before said polynomial division means for receiving said set of LPC coefficients and generating a set of vectors in accordance with a predetermined vector generation format.

6. The apparatus of claim 5 wherein said vector computation means computes two vectors P and Q in said set of vectors in accordance with the equations:

$$\begin{aligned}
&P(0) = 1\\
&P(N+1) = 1\\
&P(i) = -a(i) - a(N+1-i)\ 0 < i < N+1\\
&Q(0) = 1\\
&Q(N+1) = -1\\
&Q(i) = -a(i) + a(N+1-i);\ 0 < i < N+1.
\end{aligned}$$

7. The apparatus of claim 6 wherein said polynomial division means provides said set of quotient coefficients $J_i$ for odd line spectral square root values in accordance with the equation:

$$z^2 - 2 \cdot x_i \cdot z + 1 \frac{J_i(N-1)z^{N-1} + J_i(N-2)z^{N-2} + \ldots + J_i(1)z + J_i(0)}{\sqrt{P(N+1)z^{N+1} + P(N)z^N + \ldots + P(1)z + P(0)}},$$

where z is the polynomial variable, $x_i$ is the ith line spectral cosine value, and N is the number of filter taps.

8. The apparatus of claim 6 wherein said polynomial division means provides said set of quotient coefficients $J_i$ for even line spectral square root values in accordance with the equation:

$$z^2 - 2 \cdot x_i \cdot z + 1 \frac{J_i(N-1)z^{N-1} + J_i(N-2)z^{N-2} + \ldots + J_i(1)z + J_i(0)}{\sqrt{Q(N+1)z^{N+1} + Q(N)z^N + \ldots + Q(1)z + Q(0)}},$$

where z is the polynomial variable, $x_i$ is the ith line spectral cosine value, and N is the number of filter taps.

9. The apparatus of claim 3 wherein said sensitivity cross correlation means provides said line spectral square root sensitivity values in accordance with the equation:

$$S_i = (1 - |x_i|) \cdot \left[ R(0) \cdot R_{Ji}(0) + 2 \cdot \sum_{k=1}^{N} R(k) \cdot R_{Ji}(k) \right],$$

where $x_i$ is the ith line spectral square root value, R(k) is the kth speech autocorrelation coefficient of the set of speech samples and $R_{Ji}(k)$ is the kth autocorrelation coefficient of said set of quotient coefficients.

10. In a linear predictive coder, a sub-system for generating and encoding linear prediction coding (LPC) coefficients, comprising:

LPC generator having an input for receiving digitized speech samples and having an output to provide a set of LPC coefficients;

line spectral cosine generator having an input coupled to said LPC generator output; and line spectral square root generator having an input coupled to said line spectral cosine generator output and having an output.

11. The system of claim 10 further comprising:

polynomial division calculator having an input coupled to said line spectral square root generator output and having an output; and sensitivity cross correlation calculator having an input coupled to said polynomial division calculator output and having an output.

12. The system of claim 11 further comprising a sensitivity autocorrelation calculator disposed between said polynomial division calculator and said sensitivity cross correlation calculator having an input coupled to said polynomial division calculator output and having an output coupled to said sensitivity cross correlation calculator input.

13. In a linear predictive coder, a method for generating and encoding linear prediction coding (LPC) coefficients, comprising the steps of:

generating a set of LPC coefficients for said digitized speech samples in accordance with a linear prediction coding format;

generating a set of line spectral cosine values in accordance with a line spectral cosine values in accordance with a line spectral cosine transform format; and generating a set of line spectral square root values in accordance with a square root transformation format.

14. The method of claim 13 wherein said step of generating a set of line spectral square root values comprises:

$$y_i = \begin{cases} \frac{1}{2}\sqrt{1-x_i}\ ; & 0 \leqq x_i < 1 \\ 1 - \frac{1}{2}\sqrt{1+x_i}\ ; & -1 \leqq x_i < 0 \end{cases},$$

where $x_i$ is the ith line spectral cosine value and $y_i$ is the corresponding ith line spectral square root value.

15. The method of claim 13 further comprising the steps of:

generating a set of quotient coefficients in accordance with a predetermined polynomial division format; and computing a set of line spectral square root sensitivity coefficients in accordance with a weighted cross-correlation computation format.

16. The method of claim 15 further comprising the step of generating a set of sensitivity autocorrelation values for said set of quotient coefficients in accordance with a predetermined autocorrelation computation format.

17. The method of claim 15 further comprising the step of generating a set of vectors in accordance with a predetermined vector generation format.

18. The method of claim 17 wherein said step of generating a set of vectors comprises the steps of:

$$\begin{aligned}
&P(0) = 1\\
&P(N+1) = 1\\
&P(i) = -a(i) - a(N+1-i)\ 0 < i < N+1
\end{aligned}$$

-continued $$Q(0) = 1$$
$$Q(N+1) = -1$$
$$Q(i) = -a(i) + a(N+1-i);\ 0 < i < N+1.$$

19. The method of claim 18 wherein said step of generating a set of quotient coefficients $J_i$ for odd line spectral square root values comprises performing the following polynomial division:

$$z^2 - 2 \cdot x_i \cdot z + 1 \overline{\sqrt{P(N+1)z^{N+1} + P(N)z^N + \ldots + P(1)z + P(0)}}^{\,J_i(N-1)z^{N-1} + J_i(N-2)z^{N-2} + \ldots + J_i(1)z + J_i(0)},$$

where z is the polynomial variable, $x_i$ is the ith line spectral cosine value, and N is the number of filter taps.

20. The method of claim 18 wherein said step of generating a set of quotient coefficients $J_i$ for even line spectral square root values comprises performing the following polynomial division:

$$z^2 - 2 \cdot x_i \cdot z + 1 \overline{\sqrt{Q(N+1)z^{N+1} + Q(N)z^N + \ldots + Q(1)z + Q(0)}}^{\,J_i(N-1)z^{N-1} + J_i(N-2)z^{N-2} + \ldots + J_i(1)z + J_i(0)},$$

where z is the polynomial variable, $x_i$ is the ith line spectral cosine value, and N is the number of filter taps.

* * * * *